US008266915B2

(12) United States Patent
Saroka

(10) Patent No.: US 8,266,915 B2
(45) Date of Patent: Sep. 18, 2012

(54) ENERGY CONVERSION DEVICE

(75) Inventor: Aliaksandr Saroka, Banbury (GB)

(73) Assignee: Thermodynamic Nanotechnologies Limited, Banbury (GB)

( * ) Notice: Subject to any disclaimer, the term of this patent is extended or adjusted under 35 U.S.C. 154(b) by 563 days.

(21) Appl. No.: 12/438,917

(22) PCT Filed: Aug. 23, 2007

(86) PCT No.: PCT/GB2007/003216

§ 371 (c)(1),
(2), (4) Date: Jan. 5, 2010

(87) PCT Pub. No.: WO2008/023183

PCT Pub. Date: Feb. 28, 2008

(65) Prior Publication Data

US 2010/0115977 A1 May 13, 2010

(30) Foreign Application Priority Data

Aug. 25, 2006 (GB) ..... 0616848.8

(51) Int. Cl.
*C09K 5/04* (2006.01)

(52) U.S. Cl. ..... 62/114; 62/118

(58) Field of Classification Search ..... 62/114, 62/118, 238.1, 238.3, 324.1; 165/140.11, 165/110
See application file for complete search history.

(56) References Cited

U.S. PATENT DOCUMENTS

| | | | |
|---|---|---|---|
| 3,699,779 | A | 10/1972 | Schlichtig |
| 4,042,359 | A | 8/1977 | Schnabel et al. |
| 4,470,268 | A | 9/1984 | Schilling |
| 4,746,437 | A | 5/1988 | Koseki et al. |
| 4,877,082 | A | 10/1989 | Collins |
| 5,675,972 | A | 10/1997 | Edelson |
| 5,699,668 | A | 12/1997 | Cox |
| 2004/0221579 | A1 | 11/2004 | Baker |
| 2005/0022978 | A1 | 2/2005 | Duval |

FOREIGN PATENT DOCUMENTS

| | | |
|---|---|---|
| EP | 1559982 A | 8/2005 |
| WO | WO 00/55502 | 11/2000 |

OTHER PUBLICATIONS

International Search Report for PCT/GB2007/003216, mailed Dec. 20, 2007 in 3 pages.

*Primary Examiner* — Mohammad Ali
(74) *Attorney, Agent, or Firm* — Knobbe, Martens, Olson & Bear LLP

(57) ABSTRACT

A thermodynamic energy conversion device (14) based on the effect of differential evaporation generated by a convex liquid surface and by a temperature gradient is constructed for the use either as a heat or hydraulic pump. In one arrangement the device (14) comprises two heat conductive containers (1) and (2); a working liquid (5) disposed in said containers with open surfaces (6) and (6'); a vapor (7) of the working liquid; a porous device (8) for creating at least one convex meniscus (9) on the open surface (6), of the working liquid (5) in one of the containers said convex meniscus having higher mean curvature than that of the open surface (6'); means (10) for connecting containers (1) and (2) to an external hydraulic circuit (11). An efficient external combustion engine using such a device (14) is disclosed.

27 Claims, 8 Drawing Sheets

(a) Heat pump (b) Hydraulic pump

ENERGY CONVERSION DEVICE

CROSS-REFERENCE TO RELATED APPLICATIONS

This application is the U.S. National Phase under 35 U.S.C. §371 of International Application No. PCT/GB2007/003216, filed Aug. 23, 2007, designating the United States and published in English on Feb. 28, 2008, as WO 2008/023183, which claims priority to United Kingdom Application No. 0616848.8, filed Aug. 25, 2006.

FIELD OF THE INVENTION

The present invention relates generally to energy conversion devices. In particular, this invention pertains to conversion devices, which make use of differential evaporation generated by surface curvature and by temperature gradient, and to methods of using such devices.

DESCRIPTION OF RELATED ART

Thermodynamic energy conversion devices, which transform thermal energy into other forms of energy like mechanical or electrical and vice versa are well known from the prior art. A combustion engine working according to the Sterling cycle is an example of such a device transforming heat into mechanical energy. If the Sterling cycle is applied in the reverse direction, the same engine can be used as a heat pump, which is a device converting lower-temperature heat into higher-temperature heat with an excess of applied work; the work being mechanical in this example. The fundamental principle of thermodynamics states that the coefficient of performance of any heat engine or heat pump cannot be higher than that of a similar idealised device working according to the Carnot cycle. Therefore, thermodynamic energy conversion devices are usually rated as to their effectiveness, which is the ratio of the actual coefficient of performance to the coefficient of performance of the corresponding Carnot device.

The most commonly used heat pumps exploit the vapour compression cycle. They can be found almost in all domestic refrigerators and air conditioners. In these pumps mechanical work is applied to compress a vapour. This high-pressure vapour condenses and releases heat. Then the liquid evaporates taking heat from the environment, and the vapour has to be compressed again to complete the cycle. One of disadvantages of these heat pumps is their low effectiveness, which is typically only 0.3 for small systems and 0.5 for large-scale applications. Another disadvantage of these devices is that until recently the main working fluid was often made from chlorofluorocarbons, which contribute to the deterioration of the ozone layer and the process of global warming. Hydrofluorocarbons that can be considered as an alternative for the chlorofluorocarbons do not contribute to ozone depletion but do still contribute to global warming. Yet another disadvantage is that these heat pumps contain mechanically moving parts in the compressor. The moving parts create noise, reduce reliability and increase maintenance cost. In addition, large losses can occur in creating the work that drives the compressor.

Absorption heat pumps have a more complex cycle of operation. In general there are three different media in the system. Heat is supplied to the system to separate media and heat is rejected when one media absorbs the other. One advantage of these systems is that low quality energy, namely heat, is used to operate this type of heat pump. As a result, the overall effectiveness of a system used for domestic heating or in car air conditioning can be higher as compared to the systems relying on electrical power input. Other advantages of the absorption heat pumps are that they have no moving parts and use environmentally benign working fluids. Despite all these positive sides the effectiveness of these absorption heat pumps remains at the level of the vapour compression heat pumps. There is more equipment in an absorption system than in a vapour-compression system, and the working fluids like ammonia or lithium bromide are hazardous for humans and highly corrosive.

Thermoelectric heat pumps works on the Peltier effect; this effect is induced by an electric current flowing through a circuit consisting of two different materials. One junction between these materials becomes hot and the other one cools down. Thermoelectric heat pumps have no moving parts, but they are inefficient at room temperatures because of high reverse heat flow through the devices. Typical coefficients of performance are about one-third those of ordinary vapour compression heat pumps.

High-efficiency heat pumps working at room temperature can, in theory, be a small-scale electron emission device. The physical principle of this type of heat pumps is ejection of hot electrons over a potential barrier. The ejection process can be considered either as a thermionic or as a field electron emission. The main advantage of the electron emission devices is that their effectiveness can reach 85%. In U.S. Pat. No. 5,675,972, there is disclosed one such device as a vacuum diode heat pump. In this device the cathode receives heat at lower temperature than that of heat returned by the anode. The electrical current passing through the device performs the work required by the laws of thermodynamics. The primary challenges, yet to be overcome, in practical realisation of the electron emission devices involve finding materials with low potential barriers to achieve electron emission at room temperature and the maintenance of extremely narrow gap between electrodes to reduce the negative effect of a space charge created by the electrical current.

In U.S. Pat. No. 5,699,668, there is disclosed a multiple electrostatic gas phase heat pump, comprising many single heat pumps, each single pump having two porous electrodes separated by a porous insulating material. In said device the heat pumping capacity is provided by evaporation and ionization of a working fluid in an electric field. The practical realisation of this type of heat pump also have many challenges, mainly because the space charge effect in case of an ion current is even more restrictive as compared to the electron emission devices.

Mechanically operated hydraulic pumps are well known. The most advanced pumps can create pressure differential up to 4000 bar and above. The major disadvantages are the presence of moving parts and the complexity of construction, especially in the case of high-pressure pumps. Another disadvantage is that the complete system, which includes a drive such as an electrical motor or a combustion engine, has considerably losses in transforming electricity or heat into the mechanical energy.

In International Patent Application PCT/US2000/00483, published as WO/2000/055502, there is disclosed a hydraulic pump for manipulating fluids in capillary-based systems. The pump, which requires no moving mechanical parts, uses electro-osmotic flow to generate high pressures for pumping and/or compressing fluids. It is directly operated by applied electrical potential and has improved efficiency.

A capillary pump is a hydraulic pump directly operated by heat. It is used in capillary evaporators and in heat pipes. The capillary pumps circulate liquid by passing it through a capillary, where the liquid evaporates at a surface having a concave meniscus, and by condensing the vapour in a condenser. Because of the surface tension effect the concave meniscus generates a pressure drop at the interface of liquid and gas phases, the latter usually being a mixture of atmospheric air and liquid vapour. Since the liquid in the condenser has almost flat surface, its pressure is the same as in the gas phase. Therefore the pressure differential created by the capillary pump, that is the difference between pressures of the liquid in the capillary and in the condenser, is exactly the pressure drop generated by the concave meniscus. One big disadvantage of capillary pumps is that the pressure differential cannot be made higher than the pressure in the gas phase. An attempt to increase pressure in the gas phase would considerably slow down the vapour diffusion from the capillary to the condenser, or would require a forced vapour circulation. The efficiency of capillary pumps is also not optimal because of high heat flow through the gas phase carried by gases other than the vapour.

All combustion engines can be classified as external or internal. A classical example of the external combustion engine is a steam engine. It makes use of the thermal energy that exists in steam, converting it to mechanical work. Despite the advantage that practically any fuel can be used, the steam engines were eventually replaced by the internal combustion engines which have a higher coefficient of performance.

There are many different types of internal combustion engines known from the prior art. Essentially all of them work the same way. A mixture of air and fuel is sucked into the engine, where it is compressed. The mixture of air and fuel is then ignited. The burning gasses expand performing mechanical work, and then they are expelled from the engine. The coefficient of performance or thermal efficiency is the percentage of energy taken from the fuel combustion, which is actually converted to mechanical work. In a typical low compression engine, the thermal efficiency is only about 26%. In a highly modified engine, such as a race engine, the thermal efficiency is about 34%. After subtracting mechanical losses such as friction, the useful work typically constitutes only 20% of the energy of fuel combustion.

Since combustion engines are one of the main contributors to carbon dioxide emissions, increasing their fuel efficiency stays amongst the major ecological problems to be solved. The most promising alternatives to combustion engines such as those based on fuel cell technology still have very modest performance. For instance, if a fuel cell is powered with pure hydrogen it can convert up to 80% of the energy content of the hydrogen into electrical energy, but stored at normal conditions, hydrogen has low energy density; therefore it has to be produced from a liquid fuel like methanol. When a reformer, converting methanol to hydrogen, is added to the system, the overall efficiency drops to about 30% to 40%. Further, it is necessary to convert electrical energy from the fuel cell into mechanical work. Typical electrical motor has efficiency 80%, so that the overall efficiency of the system constitutes only about 24% to 32%.

The problems of global warming, depletion of the ozone layer, reducing carbon dioxide emission and raising fuel prices require a heat pumping solution having high effectiveness, being simple in construction, not relying on hazardous substances and being able to use low quality energy like heat for its operation. Despite a variety of approaches used in the heat pump industry no adequate solution was found till now. Therefore there is also a need for hydraulic pumps having simple construction, directly operated by electricity or heat and able to create high pressure differential at the same time. There is also a continuing need for energy-efficient combustion engines.

SUMMARY OF THE INVENTION

It has now been found that differential evaporation generated by a convex liquid surface in vapour communication with a flatter liquid surface, when used in combination with a thermal gradient, can in appropriate devices be used in energy conversion.

Thus, according to the present invention there is provided an energy conversion device comprising: a first container, a second container separated from the first container, a working liquid disposed in said first and second containers in such a way that it has an open surface within each of the containers in communication with a vapour of the working liquid, the working liquid vapour being in communication with the open surfaces of the working liquid of each container and means for connecting the working liquids of the first and second containers to an external hydraulic circuit, wherein the working liquid in the first container presents a convex meniscus surface to the vapour of working liquid in communication between the first and second containers, said convex meniscus having a higher mean curvature than the average mean curvature of the open surface of the working liquid disposed in the second container.

In a further aspect the present invention provides a heat pump, comprising one or more energy conversion devices according to the present invention.

In a further aspect the present invention provides a hydraulic pump comprising one or more energy conversion devices according to the present invention.

In a further aspect the present invention provides an external combustion engine, comprising: a hydraulic circuit having low and high pressure sides; a hydraulic pump according to the present invention connected to the hydraulic circuit; a hydraulic motor, the high pressure inlet of the hydraulic motor being connected to the high pressure side of the hydraulic circuit and the low pressure outlet of the hydraulic motor being connected to the low pressure side of the hydraulic circuit; a fuel burner attached to said hydraulic pump as the higher-temperature heat reservoir; a cooling system, attached to said hydraulic pump as the lower-temperature heat reservoir.

In a further aspect the present invention provides a heat pump system comprising: a hydraulic circuit having low and high pressure sides; a heat pump according to the present invention connected to the hydraulic circuit and a hydraulic pump according to the present invention connected to the hydraulic circuit.

In a further aspect of the present invention there is provided a method of operating an energy conversion device according to the present invention as a heat pump, the method comprising: providing a temperature differential between the first container and the second container, moving the working liquid in the external hydraulic circuit from the second container to the first container against a pressure differential; adapting the temperature differential between the containers below a critical value such that the vapour of the working liquid provides thermal energy flow from the first container to the second container In a further aspect of the present invention there is provided a method of operating an energy conversion device according to the present invention as a hydraulic pump, the method comprising: providing a temperature differential between the first container and the second container, adapting the temperature differential between the containers above a critical value such that the vapour of the working liquid provides means for mass flow from the second container to the first container, thereby moving the working liquid in the external hydraulic circuit from the first container to the second container under a pressure differential.

The device of the present invention comprises two heat conductive containers placed at a distance from each other. A working liquid is disposed within the containers in such a way that it has an open surface within each of the containers. The working liquids are in contact with the vapour of the working liquid, the vapour being in communication with each open surface of the working liquids. The first container comprises means to ensure that the working liquid in this container presents at least one convex meniscus to the vapour of the working liquid. Such means may be considered as a surface-bending device, which means a material, which by its form and/or chemical properties ensures that the surface of the working liquid in the first container forms at least one convex meniscus. The convex meniscus has a higher mean curvature than the average mean curvature of the open surface of the working liquid disposed in the second container. The first and second containers are connected to an external hydraulic circuit in such a way that the working liquid in the containers is in communication with the working liquid in the external hydraulic circuit. In devices of this arrangement the vapour of the working liquid provides mass and energy flows between the containers, and the convex menisci keep the working liquid in the first container at higher pressure than in the second container.

In order to operate the device the first container is brought into thermal contact with a lower-temperature heat reservoir and the second container is in thermal contact with a higher-temperature heat reservoir. If the temperature differential between the heat reservoirs is above some critical value, the vapour of the working liquid provides a mass flow from the second container to the first container. As a result, the working liquid in the external hydraulic circuit moves from the first container to the second container under the pressure differential, and the device works as a hydraulic pump. In turn, if the working liquid in the external hydraulic circuit is moved from the second container to the first container against the pressure differential, for example, by means of a hydraulic pump plugged into the hydraulic circuit, and the temperature differential between the heat reservoirs is below some other critical value, the vapour of the working liquid provides an energy flow from the first container to the second container. As a result, the heat flows from the lower- to higher-temperature heat reservoir, and the device works as a heat pump.

In a preferred embodiment in the device of the present invention the distance between the open surface of the working liquid disposed in the first container and the open surface of the working liquid disposed in the second container is less than the mean free path of the molecules in the vapour of the working liquid. In a preferred embodiment the space between the open surfaces of the working liquid is evacuated of all gasses and vapours other than that of the working liquid.

In a preferred embodiment the first container of the device comprises a porous material in contact with the working liquid and the vapour of the working liquid, the material having a positive contact angle with the working liquid, whereby the working liquid in contact with the porous material presents convex menisci to the vapour of the working liquid. In one embodiment the convex menisci may be presented to the vapour within the pores of the porous material. In a further embodiment the convex menisci may be presented to the vapour proximate to the membrane surface in contact with bulk working liquid in the first container. In a further embodiment the convex menisci are presented to the vapour proximate to a membrane surface, which is remote from the membrane surface in contact with bulk working fluid in the first container.

The porous material may be any suitable material, which in combination with a selected liquid produces a convex meniscus when in contact with that liquid. Examples of suitable membrane materials include carbon e.g. carbon nanotubes, polymeric organic materials, metallic materials and inorganic materials e.g. ceramic materials. When the porous material is a polymeric organic material it may require support during use, other, more rigid, membrane materials may be self-supporting. The porous material may be porous glass. The porous material may be provided as an array of a plurality of porous membrane tubes, such as for example porous glass tubes. In a preferred embodiment the porous material comprises pores of average pore size within the range of 4 to 40 nm.

The porous membrane may comprise an asymmetric distribution of pores, the smaller pores being at the exterior surface of the membrane proximate to the working liquid vapour; the pores at the side of the tubes and on the surface opposite to the surface in contact with the vapour of the working liquid may be closed occluded or masked. In a preferred embodiment the porous material in the first container comprises a hydrophobic coating.

In a further embodiment the second container of the device further comprises a porous material in contact with the working liquid and its vapour.

In the device of the present invention the distance between the first and second containers may be controlled by at least one spacer having low thermal conductivity.

A variety of working liquids may be used in the present invention. These include, water, hydrocarbons, alcohols, glycols, liquefied gases and other organic materials in liquid form. Examples include ethanol, ethylene glycol and hexylene glycol.

In one embodiment there is provided a heat pump, wherein each device is arranged in a sequence such that the second container of each device is in thermal contact with the first container of a neighbouring device, save that the first container of the first device in the sequence being in thermal contact with a first heat reservoir and the second container of the last device in the sequence being in thermal contact with a second heat reservoir, which is at a higher temperature than that of the first heat reservoir.

In a further embodiment there is provided a hydraulic pump, wherein each device is arranged in a sequence such that the second container of each device is in thermal contact with the first container of a neighbouring device, save that the first container of the first device in the sequence being in thermal contact with a first heat reservoir and the second container of the last device in the sequence being in thermal contact with a second heat reservoir, which is at a higher temperature than that of the first heat reservoir.

In these heat pumps or hydraulic pumps the plurality of devices may be connected to a common external hydraulic circuit having low and high pressure sides in such a way that the first container of each device is connected to the high pressure side of the external hydraulic circuit and the second container of each device is connected to the low pressure side of the external hydraulic circuit.

The devices of the present invention are high in effectiveness being in the range 75-80% for either mode of operation. They are simple in construction eliminating many mechanically moving parts and are quite in operation.

A further advantage of the devices operated as a hydraulic pump is the direct utilization of heat for creating the pressure differential. An advantage of the devices operated as a heat pump is the possibility of using working liquids, which are environmentally-friendly and relatively safe for human operators and users e.g. liquids such as water or ethanol. A further advantage of the device operated as a heat pump is the high density of the heat flux, which can reach 50 W/cm$^2$; this means that more compact heat pump systems can be built.

The device of the present invention may be used to construct an electrically operated heat pump system having no mechanically moving parts. The system may comprise, for example, said device operated as a heat pump and an electro-osmotic hydraulic pump supplying the device with high pressure working liquid.

The device of the present invention may be used to construct a hydraulic pump with an improved coefficient of performance by increasing the temperature differential between the heat reservoirs. This pump may comprise, for example, a plurality of said devices arranged in a sequence and placed between the heat reservoirs in such a way that the heat flows through the devices from the higher- to lower-temperature reservoir and each device works as a separate hydraulic pump.

The device of the present invention may be used to construct a heat pump working at a higher temperature differential. This heat pump may comprise, for example, a plurality of said devices arranged in a sequence and placed between the heat reservoirs in such a way that the heat flows through the devices from the lower- to higher-temperature reservoir and each device works as a separate heat pump.

Another advantage of the device is that it may be used to construct an efficient heat-operated heat pump system. The system may comprise, for example, two groups of said devices; the first group arranged to operate as a hydraulic pump provides the second group arranged to operate as a heat pump with high pressure working liquid.

The device of the present invention may be used to construct an efficient external combustion engine. The engine may comprise, for example, a plurality of said devices arranged to operate as a hydraulic pump and a hydraulic motor; the pump provides the motor with high pressure working liquid.

DETAILED DESCRIPTION

In contrast to the prior art devices the invention exploits the physical effect that pressure of both liquid and its saturated vapour is higher at a convex liquid-vapour interface than corresponding pressure at an interface having smaller curvature, for example, flat or concave. It also exploits the physical effect that pressure of the saturated vapour raises with temperature. A combination of these two effects results in a differential liquid evaporation determined by the curvature of the liquid surface and by the temperature gradient. This differential evaporation effect constitutes a basis for the invention.

More specifically, the difference between the pressure $\tilde{p}^L$ of the liquid having a convex surface and the pressure $p^L$ of the liquid having a flat surface can be found according to the Laplace formula as:

$$\tilde{p}^L - p^L = \alpha K, \tag{1}$$

where $\alpha$ is the surface tension, and K is the mean surface curvature, which for a spherical surface of radius r is 2/r. Accordingly, the ratio of the saturated vapour pressure $\tilde{p}^V$ over the convex surface to the saturated vapour pressure $p^V$ over the flat surface is given by the Lord Kelvin equation:

$$\ln\frac{\tilde{p}^V}{p^V} = \frac{\alpha v^L K}{kT}, \tag{2}$$

where $v^L$ is the volume per one molecule in the liquid, k is the Boltzmann constant, and T is the vapour absolute temperature. The temperature dependence of the saturated vapour pressure over the flat surface can be derived from the Clapeyron-Clausius equation as:

$$\ln\frac{p_H^V}{p_C^V} = \frac{q_C}{kT_C} - \frac{q_H}{kT_H} + \frac{c_p^V - c_p^L}{k}\ln\frac{T_H}{T_C}, \tag{3}$$

where $p_{H,C}{}^V$ and $q_{H,C}$ are the vapour pressure and the latent heat of evaporation per molecule at the absolute temperature $T_{H,C}$ respectively, and the constant-pressure specific heat capacities of the vapour $c_p{}^V$ and the liquid $c_p{}^L$ are also taken per one molecule. Using equations (2) and (3), and the equation of state one can find a ratio of the saturated-vapour concentration $\tilde{n}_C{}^V$ over the convex surface at temperature $T_C$ to the saturated-vapour concentration $n_H{}^V$ over the flat surface at temperature $T_H$:

$$\ln\frac{\tilde{n}_C^V}{n_H^V} = \frac{q_H}{kT_H} - \frac{\tilde{q}_C}{kT_C} + \frac{c_p^V - c_p^L - k}{k}\ln\frac{T_C}{T_H}, \quad (4)$$

where $$\tilde{q}_C = q_C - \alpha v_C^L K \quad (5)$$

is an effective latent heat of evaporation at the convex surface, and $v_C^L$ denotes the volume per one molecule in the liquid at temperature $T_C$.

Figure 1:
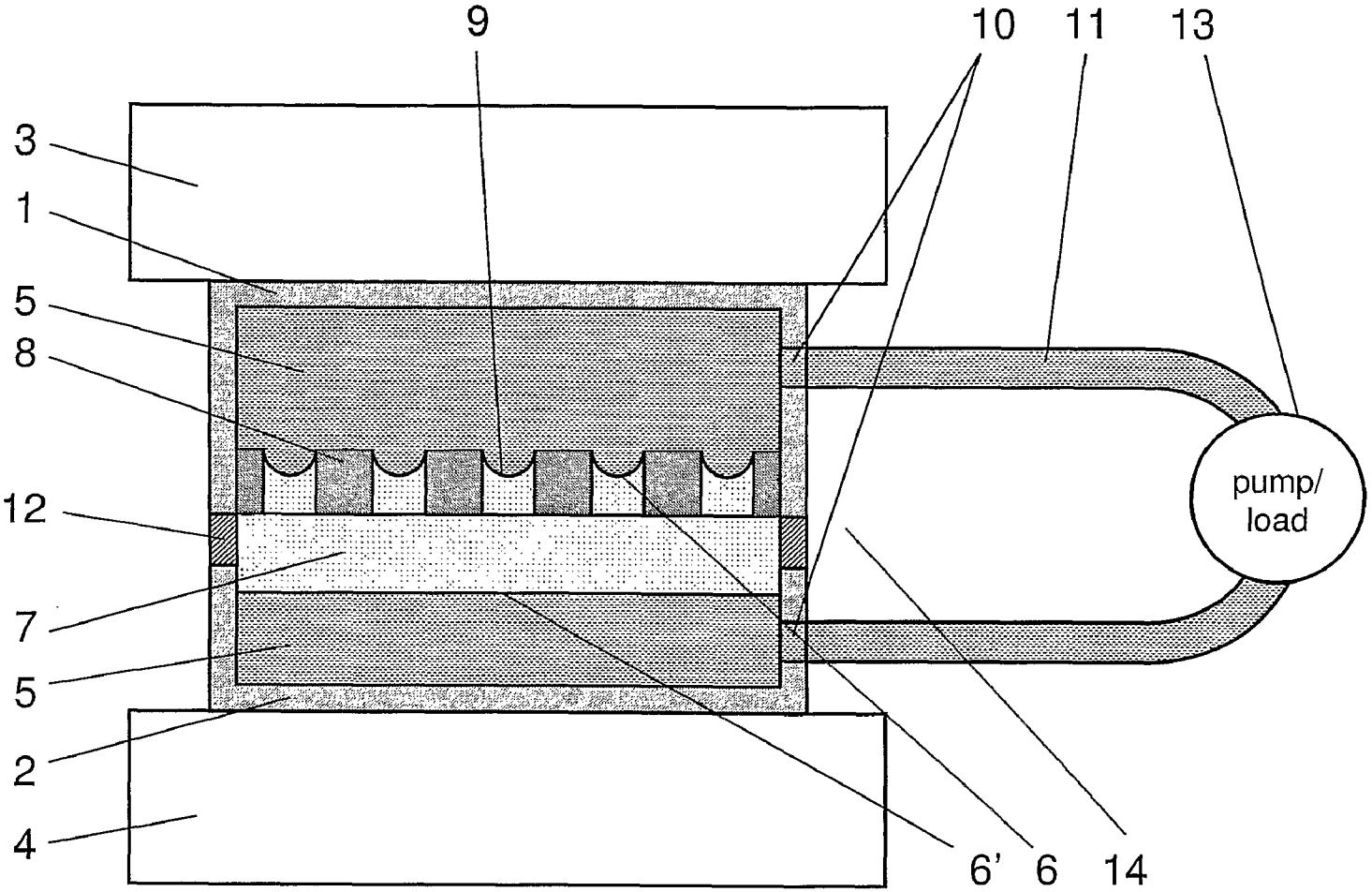
FIG. 1 shows a schematic representation of a thermodynamic energy conversion device connected to an external hydraulic circuit and in contact with heat reservoirs.
Figure 2:
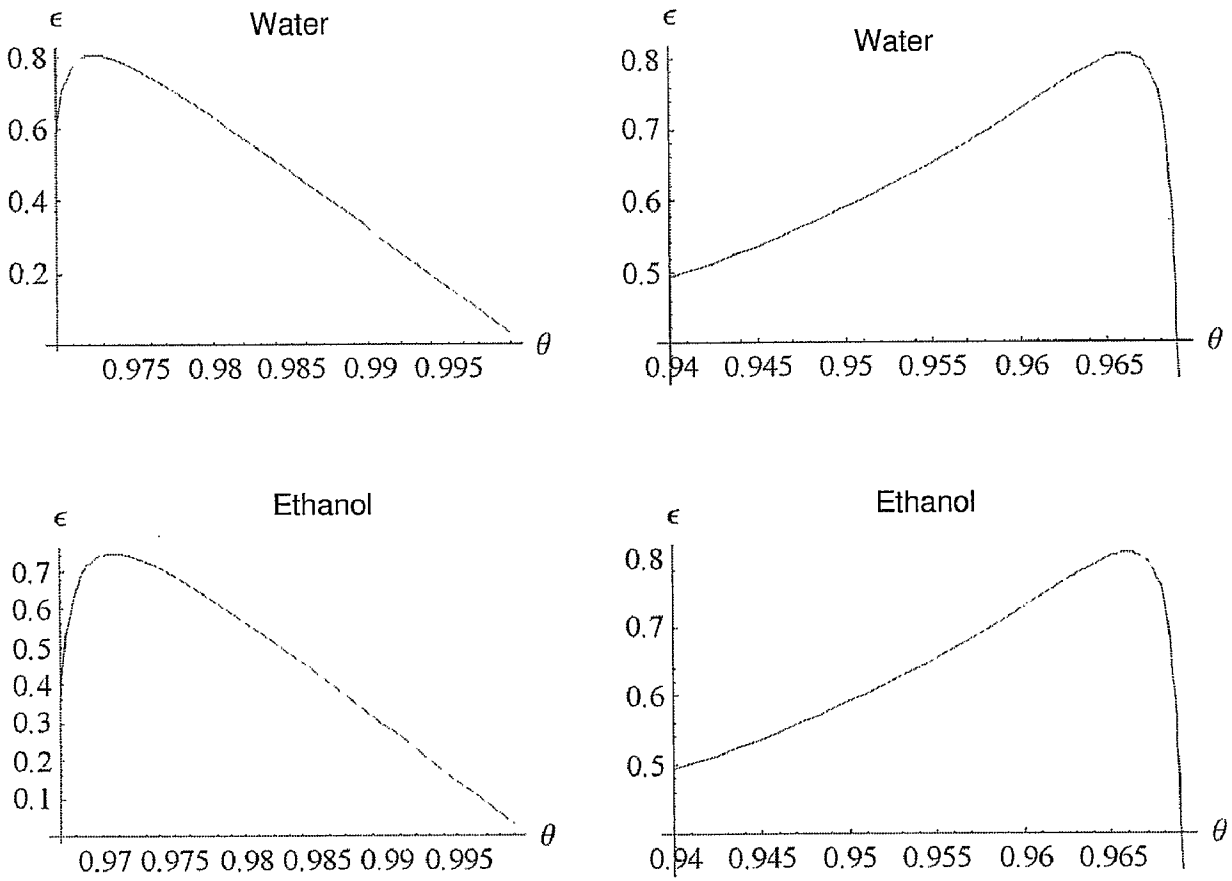
FIG. 2 shows a predicted effectiveness of a thermodynamic energy conversion device operated as a heat pump (a) or as a hydraulic pump (b) for two working liquids: water and ethanol.

A schematic representation of the invented device 14 is shown in FIG. 1. A working liquid 5 is disposed in two containers 1 and 2 so that it is in communication with its vapour 7 via open surfaces 6 and 6'. The first container 1 is in thermal contact with a heat reservoir 3 having some temperature $T_C$, and the second container 2 is in thermal contact with a heat reservoir 4 having higher temperature $T_H$. The device 14, contains a membrane device 8, which assist in creating convex menisci 9 on the open surface 6 of the working liquid 5 disposed in the container 1, the menisci having mean curvature K which is higher than the average mean curvature of the open surface 6' of the working liquid 5 disposed in the container 2. As a result, the working liquid in the container 1 has higher pressure than in the container 2. If the average mean curvature of the open surface 6' is considerably lower than that of the open surface 6, for instance the open surface 6' is flat, the pressure differential is well determined by equation (1). Accordingly, the ratio of vapour concentrations at the open surfaces 6 and 6' where the vapour state is close to saturation, is well described by equation (4).

In one preferred mode of operation the distance between the open surfaces 6 and 6' is adapted by means of spacers 12 to be less than the mean free path of the molecules in the vapour 7. The space between said open surfaces is evacuated, so that it contains mainly the vapour of the working liquid. In this case the vapour 7 provides stronger energy and mass flows between the containers 1 and 2, than they would be in the case of vapour diffusion. In particular, the Boltzmann kinetics determines the vapour flow from the container 1 as:

$$f_C^V = \tilde{n}_C^V \sigma_C \sqrt{kT_H/(2\pi m)}, \quad (6)$$

where $\sigma_C$ represents the open surface area in the container, and m is the molecular mass. In the same way, the vapour flow from the container 2 is given by the equation:

$$f_H^V = n_H^V \sigma_H \sqrt{kT_H/(2\pi m)}, \quad (7)$$

where $\sigma_H$ is the open surface area in this container, which in a typical device geometry is close to $\sigma_C$: $\sigma_H \approx \sigma_C$. Similarly, in agreement with the Boltzmann kinetics the vapour energy flows from the container 1, $g_C^V$, and from the container 2, $g_H^V$, can be calculated as:

$$g_{C,H}^V = f_{C,H}^V[c_p^V - (1/2)k]T_{C,H}, \quad (8)$$

The external hydraulic circuit 11 is brought in communication with the containers 1 and 2 by the connecting means 10. In the steady state of device operation the amount of the working liquid in any of the containers remains the same; therefore there must be a flow $f^L$ of the working liquid in the external hydraulic circuit 11 directed from the container 2 to the container 1, which exactly compensates for the net vapour flow from the container 1 to the container 2:

$$f^L = f_C^V - f_H^V, \quad (9)$$

As can be seen from equations (4), (6), (7), and (8), if the temperature differential $T_H - T_C$ is taken below some critical value, the net vapour energy flow $g_C^V - g_H^V$ from the container 1 to the container 2 becomes positive. The net vapour mass flow $f_C^V - f_H^V$ is also positive under such a condition. In this regime of operation the energy conversion device 14 works as a heat pump. According to the Energy Conservation Law the amount of heat released in the container 2 and subsequently transferred to the heat reservoir 4 per unit time is:

$$\dot{E}_H = g_C^V - g_H^V - g_H^L, \quad (10)$$

where $g_H^L$ represents the hydrodynamic energy flow that the working liquid 5 carries off the container 2:

$$g_H^L = f^L w_H^L, \quad (11)$$

where in turn $w_H^L$ is the liquid enthalpy at temperature $T_H$ per one molecule. The positive flow of the working liquid, as it follows from equation (9), means that the working liquid 5 has to be moved in the external hydraulic circuit 11 against the pressure differential. This movement can be accomplished, for example, by means of a hydraulic pump 13 plugged into the hydraulic circuit 11. The amount of work required for said movement per unit time can be calculated as:

$$\dot{A} = f^L v_C^L \alpha K. \quad (12)$$

The coefficient of performance $\eta_{heat\ pump}$ in the heat-pump regime of device operation is defined as the ratio of the transferred heat to the applied work:

$$\eta_{heat\ pump} = \dot{E}_H/\dot{A}. \quad (13)$$

In contrast to the heat-pump regime, the energy conversion device 14 works as a hydraulic pump if the temperature differential $T_H - T_C$ is taken above some other critical value such that the net vapour mass flow $m(f_C^V - f_H^V)$ is negative or, equivalently, the flow of the working liquid in the external hydraulic circuit 11 is directed from the container 1 to the container 2. Existence of the hydraulic-pump regime can be directly seen from equations (4), (6), (7), and (8). In this regime the net vapour energy flow $g_C^V - g_H^V$ from the container 1 to the container 2 also becomes negative together with $\dot{E}_H$ and $\dot{A}$. The negative values of $\dot{E}_H$ and $\dot{A}$ indicate that the heat has to be supplied to the container 2 from the heat reservoir 4, and the device performs a positive work in the external hydraulic circuit 11, for example, at a load 13. Equations (10) and (12) remain valid in this case with the only correction that the hydrodynamic energy flow $g_H^L$ has to be calculated according to the equation:

$$g_H^L = f^L[w_H^L - c_p^L(T_H - T_C)], \quad (14)$$

where one takes into account that the working liquid actually flows into the container 2 at a temperature close to $T_C$. The coefficient of performance $\eta_{hydraulic\ pump}$ in the hydraulic-pump regime of device operation is defined as the ratio of the performed work to the supplied heat:

$$\eta_{hydraulic\ pump} = \dot{A}/\dot{E}_H. \quad (15)$$

As it follows from the Second Law of Thermodynamics neither of the coefficients of performance (13) or (15) can be better than that of an analogous Carnot device, which is $\eta'_{heat\ pump} = T_H/(T_H - T_C)$ for a heat pump, and $\eta'_{heat\ engine} = (T_H - T_C)/T_H$ for any thermal engine including the heat-operated hydraulic pump. FIG. 1(*a*) shows the effectiveness $\epsilon = \eta_{heat\ pump}/\eta'_{heat\ pump}$ of the device 14 in the heat-pump regime of operation as a function of the dimensionless parameter $\theta = T_C/T_H$. The working liquid is either water or ethanol. The meniscus mean curvature K is 1 l/nm. The higher temperature $T_H$ is 293 K in case of water, and 273 K in case of ethanol. The plots show that the effectiveness can reach 80% for water and 75% for ethanol, the optimal temperature differential $T_H - T_C$ being 8 K and 9 K respectively. FIG. 1(*b*) shows the effectiveness $\epsilon = \eta_{hydraulic\ pump}/\eta'_{heat\ engine}$ of the device 14 in the hydraulic-pump regime of operation as a function of θ, the working liquids and other parameters being the same as in FIG. 1(*a*). In this case the effectiveness reaches 80% for water and 74% for ethanol at the optimal temperature differentials 10 K and 10.6 K respectively. The typical effectiveness of an internal combustion engine, which can be used as a drive for a conventional hydraulic pump, is less than 40%. Therefore in both regimes the invented device offers better effectiveness than that of analogous devices known from the prior art.

According to equation (10) the heat flux that the device 14 can deliver in the heat-pump regime is 28 W/cm2 for water and 20 W/cm2 for ethanol as the working liquid, provided the meniscus mean curvature K is 1 l/nm. If K is increased to 2 l/nm, the corresponding heat fluxes become 58 W/cm2 and 42 W/cm2. So, for example, at a conservative heat flux of 20 W/cm2, a 100,000 Btu/hr heat pump or air conditioning system would require a heating or cooling surface area of only 1,500 cm2 (or 39×39 cm2). Thus, a window-sized heat pump could replace an entire domestic heating system.

In the hydraulic-pump regime the device 14 with K of 1 l/nm and water as the working liquid can create a pressure differential of up to 74 MPa in agreement with equation (1). If for example, the open surface area $\sigma_H \approx \sigma_C$ is 0.1 m2, the water flow can reach 0.72 litres per minute as can be seen from equations (6), (7) and (9). At smaller K of 0.4 l/nm the same device creates the pressure differential of 29.6 MPa and the water flow of 0.29 litres per minute.

Figure 3:
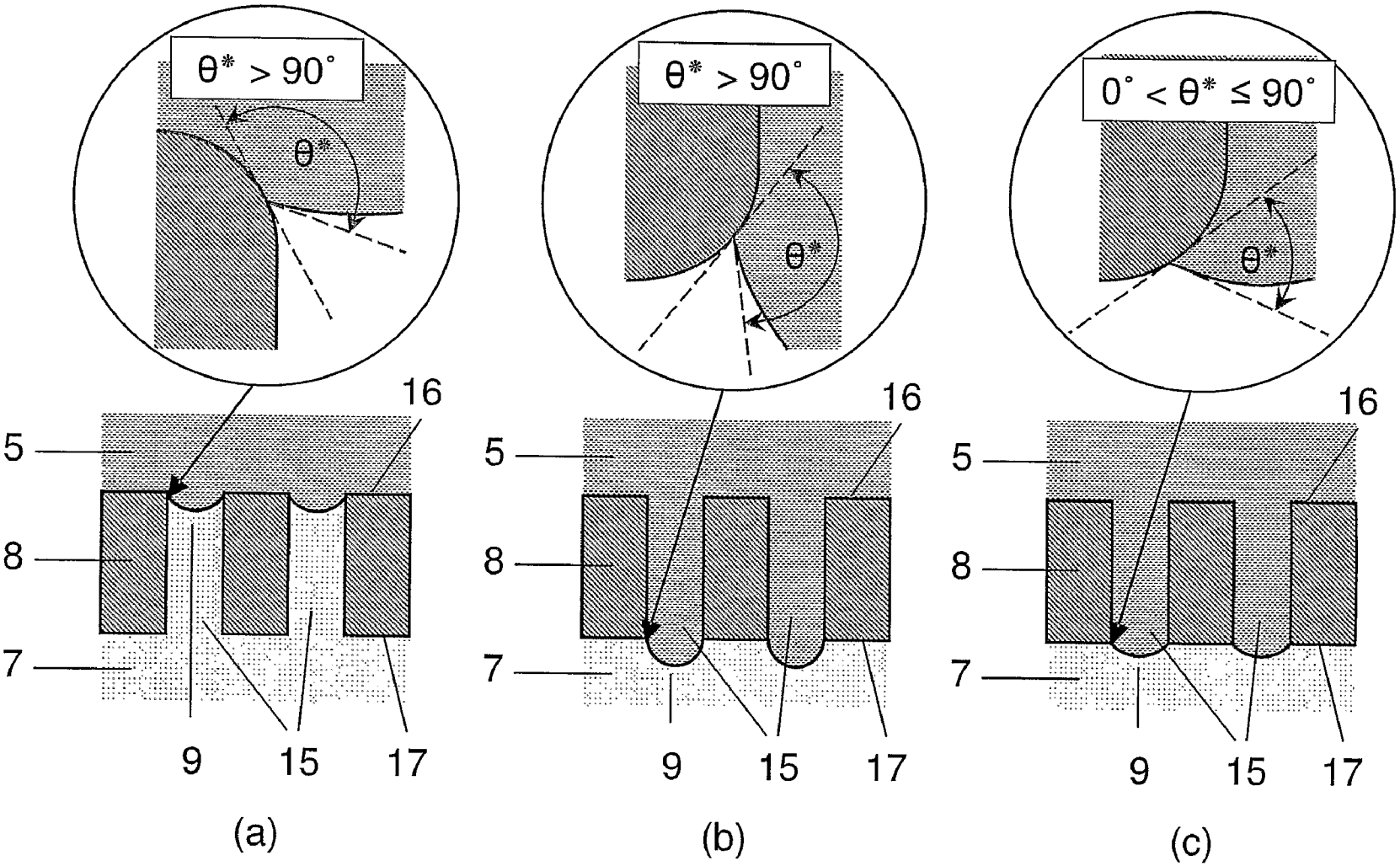
FIG. 3 shows a schematic representation of the function principle of the means to ensure that the working liquid presents a convex meniscus in cases when the working liquid has an obtuse contact angle with the device material and menisci are created at the inner (a) and at the outer (b) surface of the means, and when the working liquid has an acute contact angle with the means (c)

A schematic representation of the function principle of the device 8 is shown in FIG. 3. The device 8 is made from a material having pores 15, the inner material surface 16 being in contact with the working liquid 5, and the outer material surface 17 being in contact with the vapour 7. If the working liquid has an obtuse contact angle with the device material $\theta^* > 90°$, depending on the pressure differential between the working liquid 5 and the vapour 7, the convex menisci 9 can be created in the pores 15 either at the inner material surface 16, as shown in FIG. 3(*a*), or at the outer material surface 17, as shown in FIG. 3(*b*); the latter case, in which the menisci 9 have higher curvature, corresponds to a higher pressure differential. If the working liquid has a positive acute contact angle with the device material $0° < \theta^* \leqq 90°$, the convex menisci 9 can be created in the pores 15 only at the outer material surface 17, as shown in FIG. 3(*c*). In all cases the actual curvature of the meniscus is determined by the movable three-phase contact line between the working liquid 5, the vapour 7, and the device material at the edge of a pore 15, as seen from magnified views in FIG. 3. As a consequence, the menisci can automatically adjust themselves in response to possible small pressure variations at the high-pressure side of the external hydraulic circuit, so that there is no need for a special pressure regulator.

Figure 4:
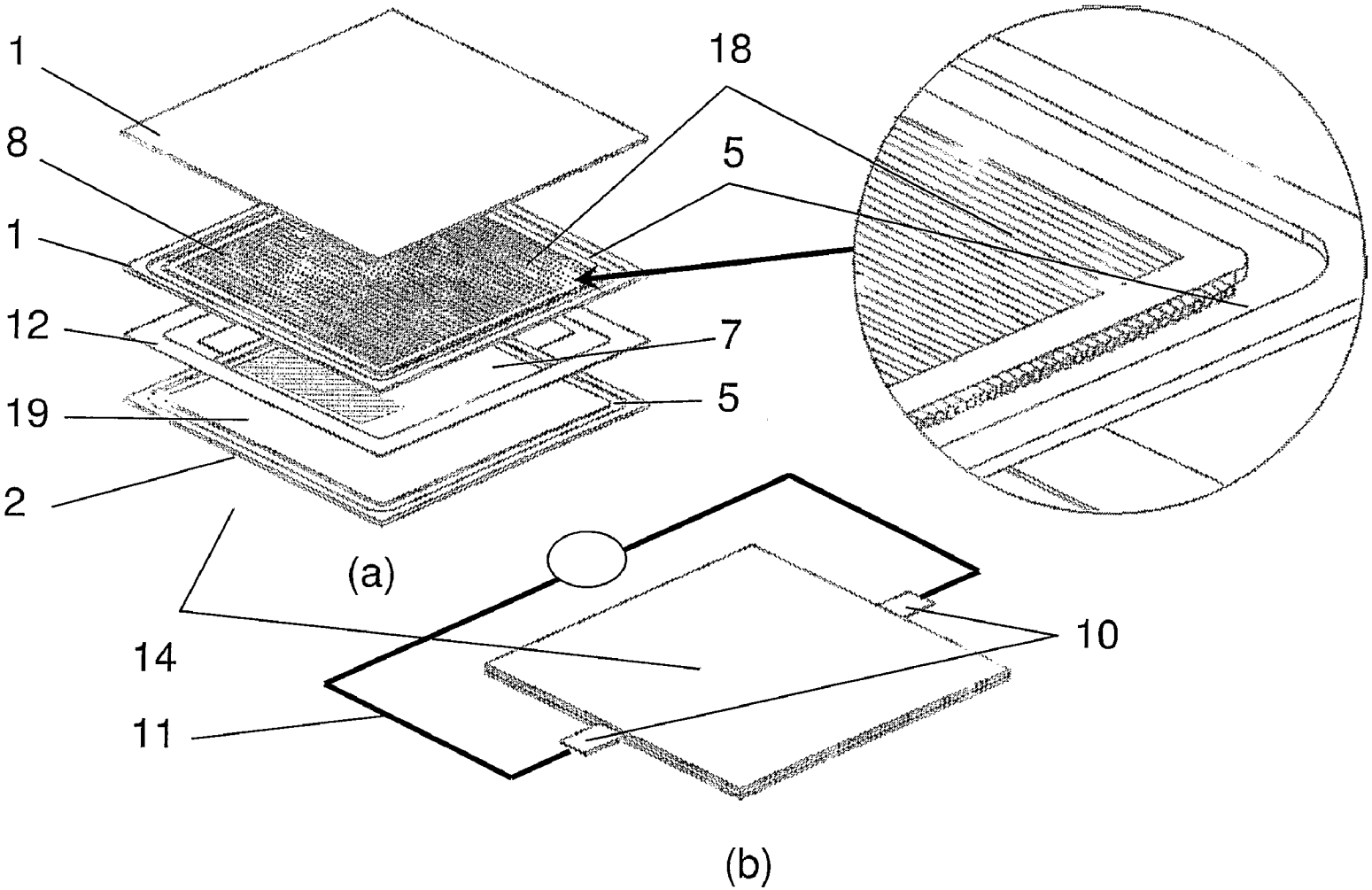
FIG. 4 shows exploded (a) and assembled (b) views of a thermodynamic energy conversion device, in which the means to ensure that the working liquid presents a convex meniscus comprises a plurality of porous glass membrane tubes.

FIGS. 4(*a*) and (*b*) show a possible embodiment of the thermodynamic energy conversion device 14, in which the membrane device 8 comprises a plurality of porous glass membrane tubes 18. The tubes have a hydrophobic coating and an asymmetric distribution of pores, the smaller pores being at the exterior surface of the tubes, and the pores at the side of the tubes opposite to the vapour of the working liquid being closed. The asymmetric distribution of pores is designed to reduce viscous resistance to the flow the working liquid through the tube walls, and the hydrophobic coating is applied to increase the contact angle θ*. Methods of fabrication of such tubes are well known from the prior art. For example, the U.S. Pat. No. 4,042,359, discloses a process for producing a tubular glass membrane with wall thicknesses between 5 and 30 microns and reproducible pore sizes between 11 A and 50 A. In this process alkali borosilicate glass is drawn into discrete hollow tubes and immediately cooled. The tubes are thermally treated to effect a phase separation into a coherent silicon dioxide phase and a boron oxide phase rich in alkali borate. The boron oxide phase is leached out with mineral acid. The tubes can be subsequently treated to give enlarged or reduced pores, asymmetric pores and coated surfaces. So for instance, the device 8 can be made of 1 cm to 10 cm long tubes, each tube having the exterior radius of 80 microns, the exterior pore size of 4 nm, the interior radius of 50 micron, and the interior pore size in the range 50-100 nm.

In the device embodiment shown in FIG. 4(*a*), the spacer 12 that controls distance between the containers 1 and 2 may have thickness in the range 0.1-0.2 mm provided the working liquid is water or ethanol. Preferably, the spacer is made from a material having low thermal conductivity to reduce the reverse heat flow between the containers.

In a preferred embodiment of the device 14 the second container 2 may further comprise a porous material 19 brought in contact with the working liquid 5 and the vapour 7, as shown in FIG. 4(*a*). In analogy with the device 8, the open surface of the working liquid disposed in the container 2 creates menisci in the pores of the material 19. Despite the requirement that said menisci have to have lower curvature than the curvature of the menisci created by the means to ensure that the working liquid presents a convex meniscus 8, the pore size can still be taken small enough, for instance in the range 10-1000 nm, so that the menisci in the container 2 can adjust themselves in response to possible small pressure variations, as explained above in the case of the means to ensure that the working liquid presents a convex meniscus. So the advantage of such a design is that there is no need for a special pressure regulator at the low pressure side of the external hydraulic circuit 11, to which the device 14 is connected by means of two adaptors 10, as shown in FIG. 4(*b*). Another advantage is that the container 2 can hold the working liquid 5 in any position with respect to gravity.

In order to operate the device 14 as a heat pump any high-pressure hydraulic pump can be used to move the working liquid 5 in the external hydraulic circuit 11, for instance, an electro-osmotic hydraulic pump or another device 14 operated as a hydraulic pump. In these particular embodiments the complete heat pump system directly consumes electrical or heat power and benefits from having no mechanically moving parts.

Figure 5:
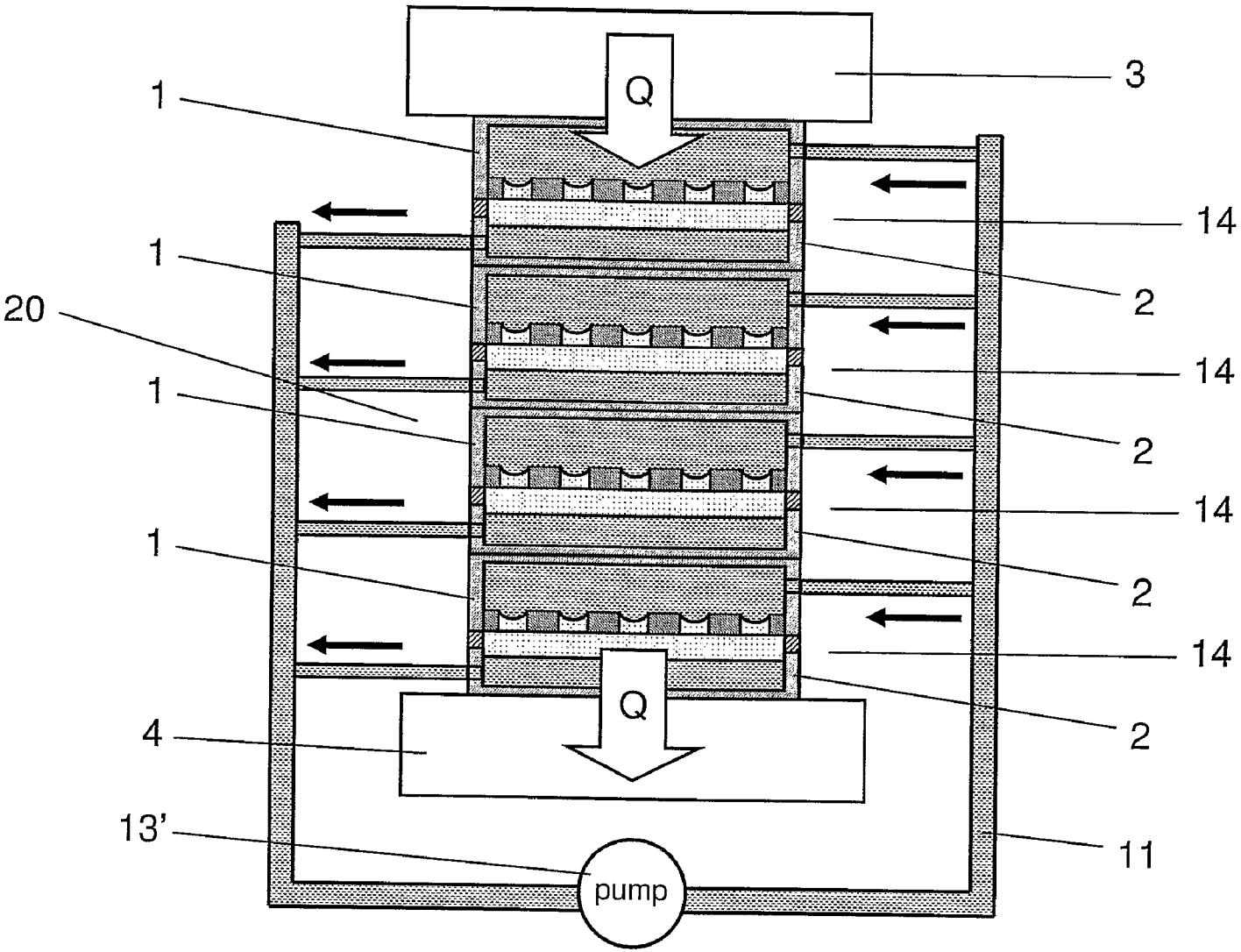
FIG. 5 shows a schematic representation of a heat pump with the enlarged temperature differential comprising a plurality of thermodynamic energy conversion devices.

FIG. 5 shows a schematic representation of a heat pump 20 comprising a plurality of thermodynamic energy conversion devices 14. The devices are arranged in a sequence such that the container 2 of one device is thermally connected to the container 1 of another device, the container 1 of the first device is in thermal contact with the lower-temperature heat reservoir 3 and the container 2 of the last device is in thermal contact with the higher-temperature heat reservoir 4. In this arrangement each container 2 serves as the lower-temperature heat reservoir for the next conjoint device, and each container 1 serves as the higher-temperature heat reservoir for the previous conjoint device. If the temperature differential applied to each device 14 is below the critical value, as explained above, all devices work in the heat-pump regime transferring heat from one to another and thereof from the heat reservoir 3 to the heat reservoir 4. The effectiveness ϵ of such a combined heat pump cannot be worse than that of a separate device 14, whereas the temperature differential between the heat reservoirs 4 and 3 $T_H - T_C$ is a sum of temperature differentials of separate devices. Thus, practically for any temperature differential $T_H - T_C$ an efficient heat pump can be constructed.

For instance, a heat pump comprising 10 thermodynamic energy conversion devices may have the coefficient of performance $\eta_{heat\ pump}$ as high as 3.6 for water and 2.9 for ethanol at $T_H-T_C$ equal 80 K and 90 K respectively.

In a particular embodiment of the heat pump 20 shown in FIG. 5, the thermodynamic energy conversion devices 14 are connected to a common external hydraulic circuit 11 having low and high pressure sides in such a way that the container 1 of each device 14 is connected to the high pressure side, and the container 2 is connected to the low pressure side. Although the effectiveness $\epsilon$ in this case can be slightly lower than in cases where each device has a separate hydraulic circuit, the advantage is that the only one hydraulic pump 13' is required to supply all devices with the high pressure working liquid.

Figure 6:
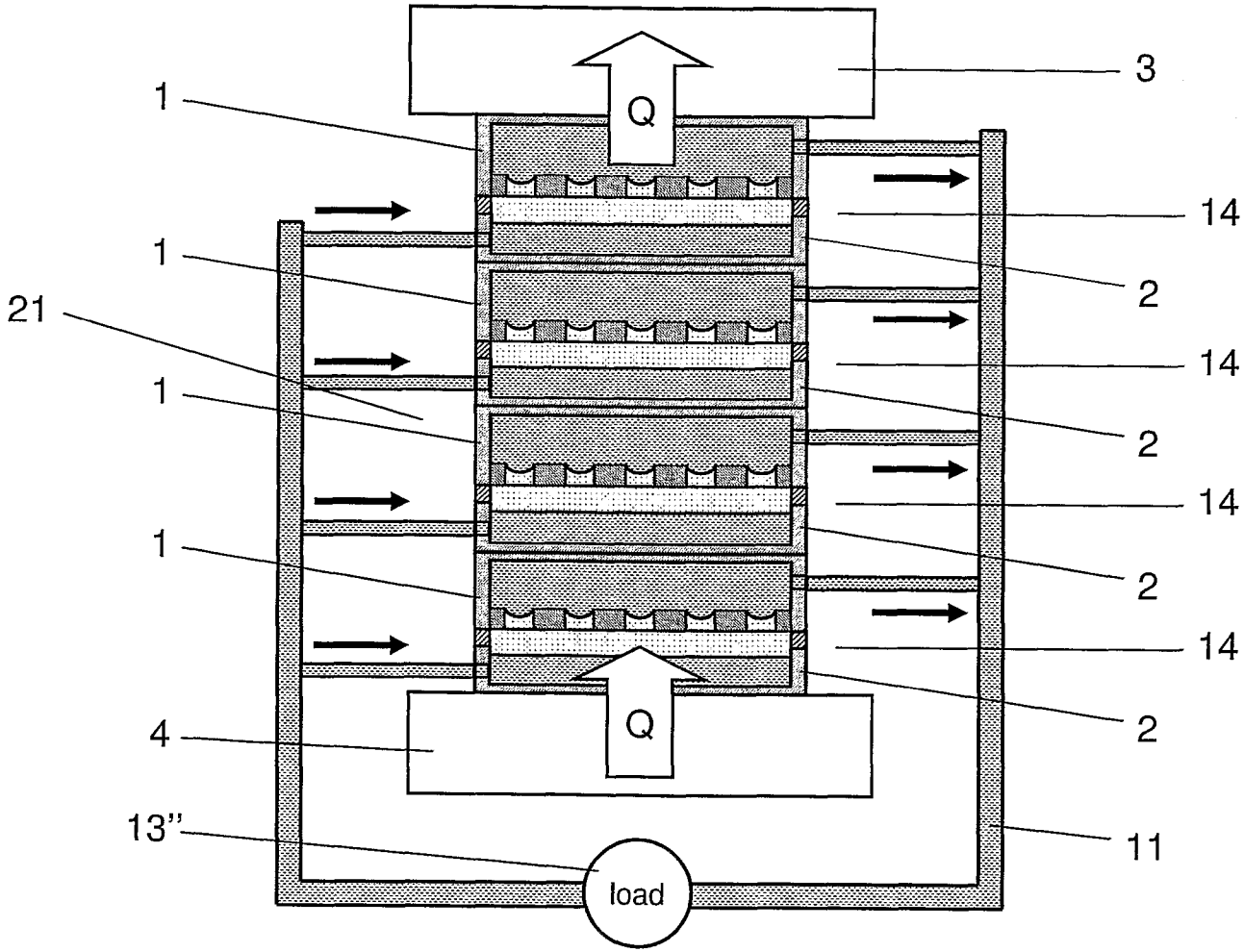
FIG. 6 shows a schematic representation of a hydraulic pump with the improved coefficient of performance comprising a plurality of thermodynamic energy conversion devices.

FIG. 6 shows a schematic representation of a hydraulic pump 21 comprising a plurality of thermodynamic energy conversion devices 14. The devices are arranged in a sequence similar to that of a heat pump 20 in FIG. 5. If the temperature differential applied to each device 14 is above the critical value, as explained above, all devices work in the hydraulic-pump regime transferring heat from one to another with the deduction of a performed work. As a result, the overall performed work is the difference between the heat absorbed from the higher-temperature heat reservoir 4 and the heat returned to the lower-temperature heat reservoir 3. The effectiveness $\epsilon$ of such a combined hydraulic pump can not be worse than that of a separate device 14, whereas the temperature differential between the heat reservoirs 4 and 3 $T_H-T_C$ is a sum of temperature differentials of separate devices. Since the Carnot efficiency $\eta'_{heat\ engine}$ increases with $T_H-T_C$, the coefficient of performance $\eta_{hydraulic\ pump}$ of the hydraulic pump 21 is higher than that of a separate device 14, which is working at a lower temperature differential. Thus, a hydraulic pump with the improved coefficient of performance can be constructed. For instance, a hydraulic pump using water as the working liquid and comprising 30 thermodynamic energy conversion devices may have $\eta_{hydraulic\ pump}$ of up to 40% at $T_H-T_C$ around 300 K.

In a particular embodiment of the hydraulic pump 21 shown in FIG. 6, the thermodynamic energy conversion devices 14 are connected to a common external hydraulic circuit 11 having low and high pressure sides in such a way that the container 1 of each device 14 is connected to the high pressure side, and the container 2 is connected to the low pressure side. As a result separate flows of the working liquid through the devices 14 are joined together creating a much stronger flow. Although the effectiveness $\epsilon$ in this case can be slightly lower than in cases where each device performs work in a separate hydraulic circuit, the advantage is that a single hydraulic load 13" can be used.

Figure 7:
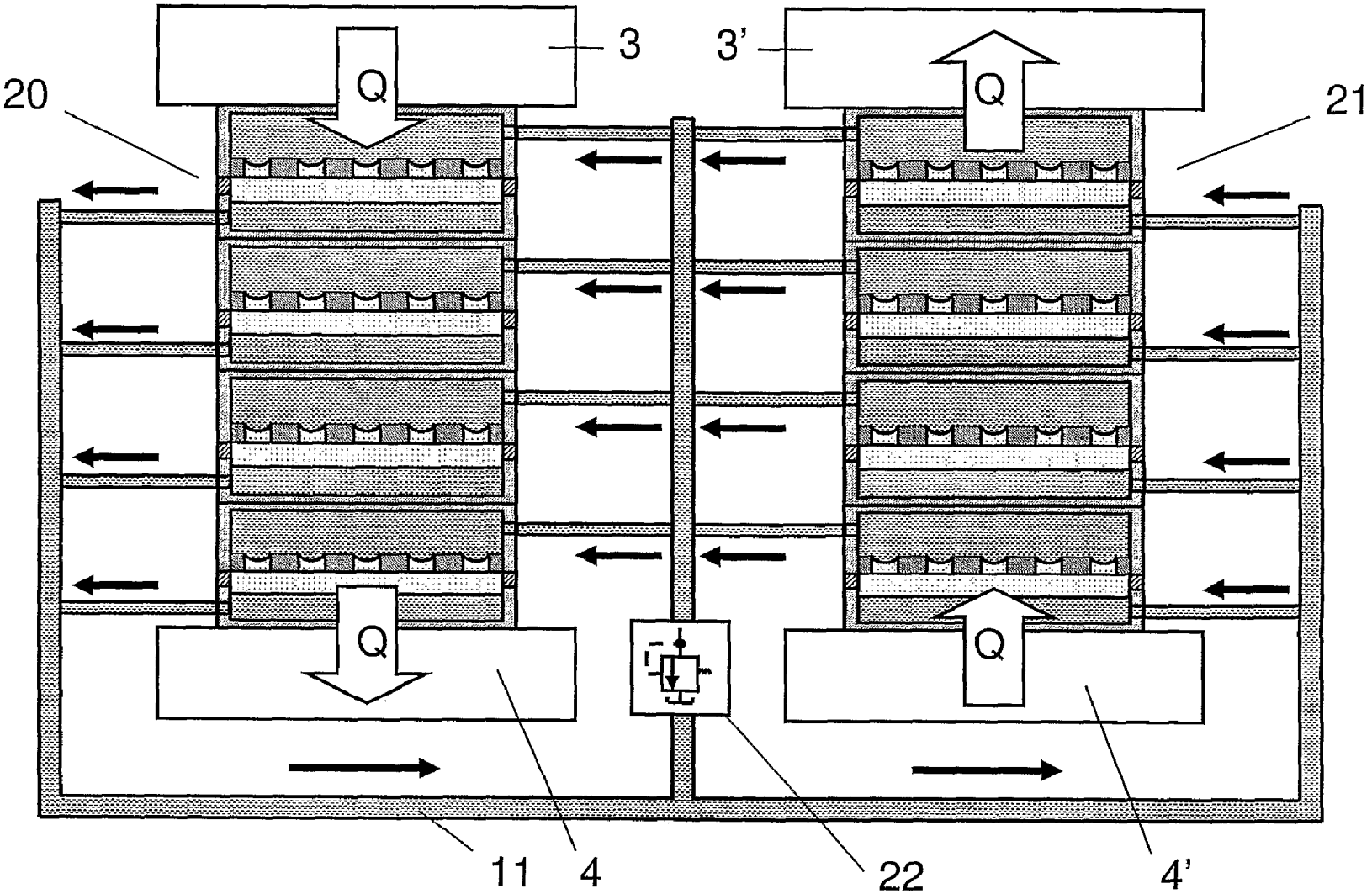
FIG. 7 shows a schematic representation of a heat pump system using a heat pump with the enlarged temperature differential and a hydraulic pump with the improved coefficient of performance.

FIG. 7 shows a schematic representation of a heat pump system comprising a hydraulic circuit 11 having low and high-pressure sides, a heat pump 20 and a hydraulic pump 21. The low and high pressure openings of the pumps 20 and 21 are connected to the low and high pressure sides of the hydraulic circuit 11 respectively, so that the hydraulic pump 21 provides the heat pump 20 with the high pressure working liquid. The heat pump system may further comprise a pressure relief valve 22 plugged between the low and high-pressure sides of the hydraulic circuit 11 and other control and safety devices. The coefficient of performance of such a system is defined as the ratio of the total heat released both in the high-temperature heat reservoir 4 in contact with the heat pump 20 and in the low-temperature heat reservoir 3' in contact with the hydraulic pump 21 to the heat absorbed from the high-temperature heat reservoir 4' in contact with the hydraulic pump 21. If, for instance, the temperatures of the heat reservoirs 3 and 4 are 263 K and 333 K respectively, and those of the heat reservoirs 3' and 4' are 333 K and 443 K, the coefficient of performance of the heat pump system can reach 1.46, provided the working liquid is ethanol. If the temperature of the heat reservoirs 4 and 3' is decreased to 303 K, the coefficient of performance of the same heat pump system increases to 2.1. These figures show that such a heat pump system can be 1.5-2 times more efficient than the most efficient domestic condensing boiler even if the outside temperature is as low as −10° C.

Figure 8:
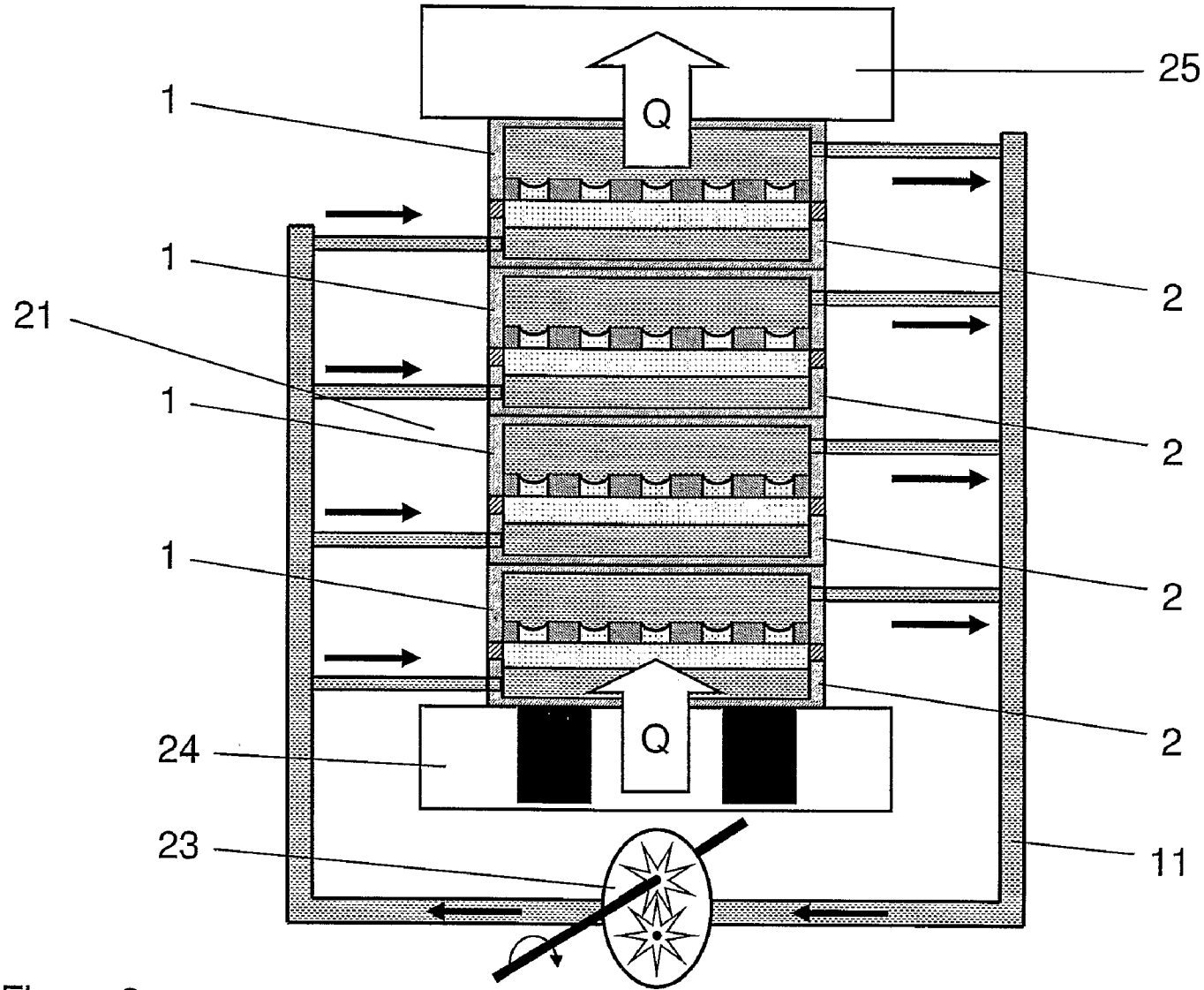
FIG. 8 shows a schematic representation of an external combustion engine using a hydraulic pump with the improved coefficient of performance.

FIG. 8 shows a schematic representation of an external combustion engine comprising a hydraulic pump with the improved coefficient of performance 21; a hydraulic circuit 11 having low and high pressure sides, the low and high pressure openings of the pump 21 being connected to the low and high pressure sides of the hydraulic circuit 11 respectively; a hydraulic motor 23, the high pressure inlet of the hydraulic motor 23 being connected to the high pressure side of the hydraulic circuit 11 and the low pressure outlet of the hydraulic motor 23 being connected to the low pressure side of the hydraulic circuit 11; a fuel burner 24 attached to the hydraulic pump 21 as the higher-temperature heat reservoir; and a cooling system 25, attached to the hydraulic pump 21 as the lower-temperature heat reservoir. The function principle of the engine is very simple. If fuel is burned in the burner 24, the hydraulic pump 21 receives required heat and creates a flow of high pressure working liquid directed through the hydraulic circuit 11 to the hydraulic motor 23. The motor 23 in turn performs a mechanical work rejecting low pressure working liquid, which is directed back to the pump 21. Any heat unused by the pump 21 is transferred to the surroundings with the help of the cooling system 25. Such a design benefits from having very little moving parts; compact size; smooth, silent operation; possibility to use a variety of fuels; and, most importantly, from having a high coefficient of performance, which can reach, for instance, 40% if the working liquid is water and the temperature differential is about 300 K. Thus, the engine can be a viable energy-efficiency alternative not only for the modern internal combustion engines, whose coefficient of performance is about 26%, but also for the most perspective solutions using fuel cell technology, where the overall coefficient of performance that takes into account energy losses in a methanol-to-hydrogen reformer and in an electrical motor can reach only 32%.

What is claimed is:

1. An energy conversion device comprising: a first container, a second container separated from the first container, a working liquid disposed in said first and second containers in such a way that it has an open surface within each of the containers in communication with a vapour of the working liquid, the working liquid vapour being in communication with the open surfaces of the working liquid of each container and means for connecting the working liquids of the first and second containers to an external hydraulic circuit, wherein the working liquid in the first container presents a convex meniscus surface to the vapour of working liquid in communication between the first and second containers, said convex meniscus having a higher mean curvature than the average mean curvature of the open surface of the working liquid disposed in the second container.

2. A device according to claim 1, wherein the distance between the open surface of the working liquid disposed in the first container and the open surface of the working liquid disposed in the second container is less than the mean free path of the molecules in the vapour of the working liquid.

3. A device according to claim 1 or claim 2, wherein the space between the open surfaces of the working liquid is evacuated of all gasses and vapours other than that of the working liquid.

4. A device according to any one of the preceding claims, wherein the first container comprises a porous material in contact with the working liquid and the vapour of the working liquid, the material having a positive contact angle with the working liquid, to the vapour of the working liquid.

5. A device according to claim 4, wherein the convex menisci are presented to the vapour within the pores of the porous material.

6. A device according to claim 4, wherein the convex menisci are presented to the vapour proximate to the membrane surface in contact with bulk working liquid in the first container.

7. A device according to claim 4, wherein the convex menisci are presented to the vapour proximate to a membrane surface which is remote from the membrane surface in contact with bulk working fluid in the first container.

8. A device according to any of the preceding claims, wherein the first container comprises a plurality of porous membrane tubes.

9. A device as claimed in claim 8, wherein the tubes are porous glass.

10. A device according to claim 8 or claim 9, wherein the porous membrane tubes comprise an asymmetric distribution of pores, the smaller pores being at the exterior surface of the tubes, and the pores at the side of the tubes opposite to the side in contact with the vapour of the working liquid being closed.

11. A device according to any one of the preceding claims, wherein the second container further comprises a porous material in contact with the working liquid and its vapour.

12. A device according to any one of claims 1 to 11, wherein the distance between the first and second containers is controlled by at least one spacer having low thermal conductivity.

13. A device according to any of the claims 1 to 12, wherein the working liquid is water.

14. A device according to any of the claims 1 to 12, wherein the working liquid is a hydrocarbon.

15. A device as claimed in any one of claims 1 to 12, wherein the working liquid is an alcohol.

16. A device as claimed in any one of claim 15, wherein the alcohol is ethanol.

17. A device as claimed in any one of claims 1 to 12, wherein the working liquid is a liquid gas.

18. A device as claimed in claim 17, wherein the heat reservoir of the first container is at a lower temperature than that of the second container.

19. A heat pump, comprising a plurality of devices according to any one of claims 1 to 18.

20. A heat pump as claimed in claim 19, wherein each device is arranged in a sequence such that the second container of each device is in thermal contact with the first container of a neighbouring device, save that the first container of the first device in the sequence being in thermal contact with a first heat reservoir and the second container of the last device in the sequence being in thermal contact with a second heat reservoir, which is at a higher temperature than that of the first heat reservoir.

21. A hydraulic pump comprising a plurality of devices according to any one of claims 1 to 18.

22. A hydraulic pump as claimed in claim 21, wherein each device is arranged in a sequence such that the second container of each device is in thermal contact with the first container of a neighbouring device, save that the first container of the first device in the sequence being in thermal contact with a first heat reservoir and the second container of the last device in the sequence being in thermal contact with a second heat reservoir, which is at a higher temperature than that of the first heat reservoir.

23. A heat pump or a hydraulic pump according to any one of claims 19 to 22, wherein the devices are connected to a common external hydraulic circuit having low and high pressure sides in such a way that the first container of each device is connected to the high pressure side of the external hydraulic circuit and the second container of each device is connected to the low pressure side of the external hydraulic circuit.

24. A heat pump system comprising: a hydraulic circuit having low and high-pressure sides, a heat pump according to claim 19 connected to the hydraulic circuit and a hydraulic pump according to claim 21 connected to the hydraulic circuit.

25. An external combustion engine, comprising: a hydraulic circuit having low and high pressure sides; a hydraulic pump according to claim 21 connected to the hydraulic circuit; a hydraulic motor, the high pressure inlet of the hydraulic motor being connected to the high pressure side of the hydraulic circuit and the low pressure outlet of the hydraulic motor being connected to the low pressure side of the hydraulic circuit; a fuel burner attached to said hydraulic pump as the higher-temperature heat reservoir; a cooling system, attached to said hydraulic pump as the lower-temperature heat reservoir.

26. A method of operating a device as claimed in any one of claims 1 to 18 as a heat pump, the method comprising: providing a temperature differential between the first container and the second container, moving the working liquid in the external hydraulic circuit from the second container to the first container against a pressure differential; adapting the temperature differential between the containers below a critical value such container to the second container.

27. A method of operating a device according to any of the claims 1 to 18 as a hydraulic pump, the method comprising: providing a temperature differential between the first container and the second container, adapting the temperature differential between the containers above a critical value such that the vapour of the working liquid provides means for mass flow from the second container to the first container, thereby moving the working liquid in the external hydraulic circuit from the first container to the second container under a pressure differential.

* * * * *